US007422128B1

(12) United States Patent
Cline

(10) Patent No.: US 7,422,128 B1
(45) Date of Patent: Sep. 9, 2008

(54) CAROUSEL DISPENSER ESPECIALLY FOR PERIODICALS

(76) Inventor: Jody A. Cline, 2240 23rd Ave., Sacramento, CA (US) 95822

( * ) Notice: Subject to any disclaimer, the term of this patent is extended or adjusted under 35 U.S.C. 154(b) by 156 days.

(21) Appl. No.: 11/326,851

(22) Filed: Jan. 6, 2006

(51) Int. Cl.
*G07F 11/00* (2006.01)

(52) U.S. Cl. ..... 221/121; 221/119; 221/120

(58) Field of Classification Search ..... 221/119, 221/120, 121
See application file for complete search history.

(56) References Cited

U.S. PATENT DOCUMENTS

| | | | | | |
|---|---|---|---|---|---|
| 1,344,160 | A | * | 6/1920 | Wright | 221/120 |
| 1,645,442 | A | | 10/1927 | Meyer | |
| 1,696,365 | A | | 12/1928 | Smith | |
| 2,394,292 | A | | 2/1946 | Cubete | |
| 2,792,147 | A | | 5/1957 | Stewart | |
| 3,912,124 | A | | 10/1975 | Pinkerton | |
| 3,946,846 | A | | 3/1976 | Pepiciello | |
| 4,049,154 | A | * | 9/1977 | Burks | 221/120 |
| 4,199,077 | A | | 4/1980 | Lacewell | |
| 4,473,172 | A | | 9/1984 | Reynolds | |
| 4,498,603 | A | * | 2/1985 | Wittenborg | 221/120 |
| 4,621,746 | A | * | 11/1986 | Reichle et al. | 221/76 |
| 4,770,321 | A | | 9/1988 | Anderson | |
| 5,067,630 | A | | 11/1991 | Nesser | |
| 5,385,266 | A | | 1/1995 | Pate | |
| 5,492,213 | A | | 2/1996 | Kim | |
| 5,813,568 | A | | 9/1998 | Lowing | |
| 6,003,725 | A | | 12/1999 | Blankenau et al. | |
| 6,283,326 | B1 | | 9/2001 | Lindsey | |
| 6,467,649 | B1 | | 10/2002 | Ullman | |
| 6,811,053 | B2 | | 11/2004 | Schwarzli | |

* cited by examiner

*Primary Examiner*—Gene O. Crawford
*Assistant Examiner*—Timothy R Waggoner
(74) *Attorney, Agent, or Firm*—Heisler & Associates

(57) ABSTRACT

A dispenser is provided with a carousel rotatably supported within a housing. The carousel includes multiple cells spaced circumferentially from each other upon the carousel. A door is provided in the housing which provides access to one cell. Each cell can contain an item, such as a newspaper, to be dispensed. A coin-op is mounted to the dispenser and allows a lever to be manually actuated when payment is made. When the lever is actuated, a latch of a door control assembly is released so that the door can be opened. The lever also causes an arm of a carousel control assembly to be rotated, which arm causes the carousel to be rotated along with the lever. Dividers between adjacent cells in the carousel preclude access to adjacent cells when a user has access to one of the cells through the door, such that theft is precluded.

3 Claims, 7 Drawing Sheets

CAROUSEL DISPENSER ESPECIALLY FOR PERIODICALS

FIELD OF THE INVENTION

The following invention relates to vending machines and other dispensers for items and particularly items which are being vended. More particularly, this invention relates to vending machines which place items to be vended within individual cells of a carousel and include features to preclude theft of items from cells adjacent to a cell containing an item being vended.

BACKGROUND OF THE INVENTION

Vending machines have long been in existence and provide a convenient and low cost way to distribute goods to purchasers. In particular, no sales personnel need be present to collect the payment or deliver the item being purchased. Rather, payment is secured within a vault and the vending machine allows the purchaser to gain access to the items being sold. Personnel thus need only periodically visit the vending machine to collect the money from the vault and reload the vending machine with items to be purchased.

While vending machines can be an efficient way to sell many items, some items have not heretofore been suitable for distribution from vending machines without significant risk of theft. Newspapers in particular, due to their large size, have required vending machines which give purchasers access to an entire stack of newspapers. With a typical newspaper vending machine (such as those provided by Kasper Wire Works Incorporated of Shiner, Tex.), the purchaser places coins into the vending machine to unlock a door of the vending machine. The door can then be opened and the purchaser has access to the entire stack of newspapers. This type of vending machine necessarily requires that the purchaser have sufficient integrity to only take one newspaper. Unfortunately, a significant percentage of the population is not willing to honor the trust given to them by prior art newspaper vending machines. As newspapers increase in price, the need to preclude such newspaper theft has increased.

In addition, many periodicals of higher value have not been successfully distributed through vending machines due to the unacceptably high cost of theft. For instance, magazines, and particularly weekly magazines, have a relatively high value and also take up a significant amount of space such that such magazines cannot be successfully sold through most common prior art vending machines. A need exists for a vending machine which can vend newspapers, magazines or other periodicals or other items in a way that precludes the likelihood of theft while still providing the convenience and cost effectiveness of distribution of such periodicals or other items by vending.

Furthermore, newspapers and other periodicals often generate significant income through advertising. One important aspect of advertising sales with periodicals is that the circulation rate of the periodical must be accurately known for the advertising rates to be properly calculated. With significant amounts of theft through vending machines, the accuracy of circulation information is thrown into doubt, making it more difficult to fairly charge advertisers for the degree of exposure the advertisements are getting. With a vending machine that can more successfully preclude theft, circulation numbers can be more accurately reported.

SUMMARY OF THE INVENTION

With this invention a dispenser of a carousel type is provided that is particularly adapted for dispensing newspapers or other similar periodicals or other items. The dispenser is particularly configured to preclude theft while still maintaining a sufficient ease of operation to avoid placing impediments between a prospective purchaser and utilization of the vending machine.

The dispenser includes a housing which is typically generally cylindrical with a door or other opening in a side wall of the housing selectively openable to allow access into an interior of the housing. A carousel is located within the housing which has a plurality of cells oriented between dividers on the carousel. The carousel is adapted to rotate within the housing so that each of the cells can individually be sequentially aligned with the door. Each of the cells is sized so that it can receive one of the items, such as a newspaper, to be dispensed from the dispenser. The cells are isolated from each other so that when a purchaser has access to one of the cells of the dispenser, the purchaser does not have access to any of the other cells within the dispenser.

Most preferably, the dispenser is activated with coins, preferably through a standard coin-op machine similar to that utilized with standard prior art newspaper vending machines. Thus, a user places coins into the coin-op causing the dispenser and an associated carousel rotator mechanism to transition from a locked to an unlocked configuration. A lever can then be manually rotated by the user. This lever both rotates the carousel to advance a new cell in line with the door, and also releases a latch on the door so that the door can be opened. The user can then open the door and access the new cell with the new item located within the cell in the carousel. When the door is closed, the latch typically re-locks the door and the entire dispenser is returned to a locked configuration until additional coins are inserted into the coin-op.

A window is preferably provided adjacent the door which shows an adjacent cell of the carousel which is to be aligned with the door upon the next utilization of the dispenser. Hence, a user can readily see if further items remain to be dispensed, or if the dispenser if empty. Preferably, a carousel release mechanism is provided which is key activated and allows the carousel to rotate freely. Such a carousel release allows a service person to quickly load all of the cells of the carousel through the door.

OBJECTS OF THE INVENTION

Accordingly, a primary object of the present invention is to provide a dispenser for periodicals or other items which precludes theft of items from the dispenser. Another object of the present invention is to provide a periodical dispenser of a carousel variety.

Another object of the present invention is to provide a vending machine which precludes theft of items.

Another object of the present invention is to provide a periodical vending machine which can be utilized with a single hand.

Another object of the present invention is to provide a periodical dispenser which can be easily used to purchase a single periodical, but which precludes theft of additional periodicals.

Another object of the present invention is to provide a newspaper vending machine which can be easily loaded with newspapers.

Another object of the present invention is to provide a dispenser for periodicals or other items which is of durable and reliable construction, has a relatively small footprint and an attractive appearance.

Other further objects of the present invention will become apparent from a careful reading of the included drawing figures, the claims and detailed description of the invention.

DESCRIPTION OF THE PREFERRED EMBODIMENT

Figures 1, 2, 3:
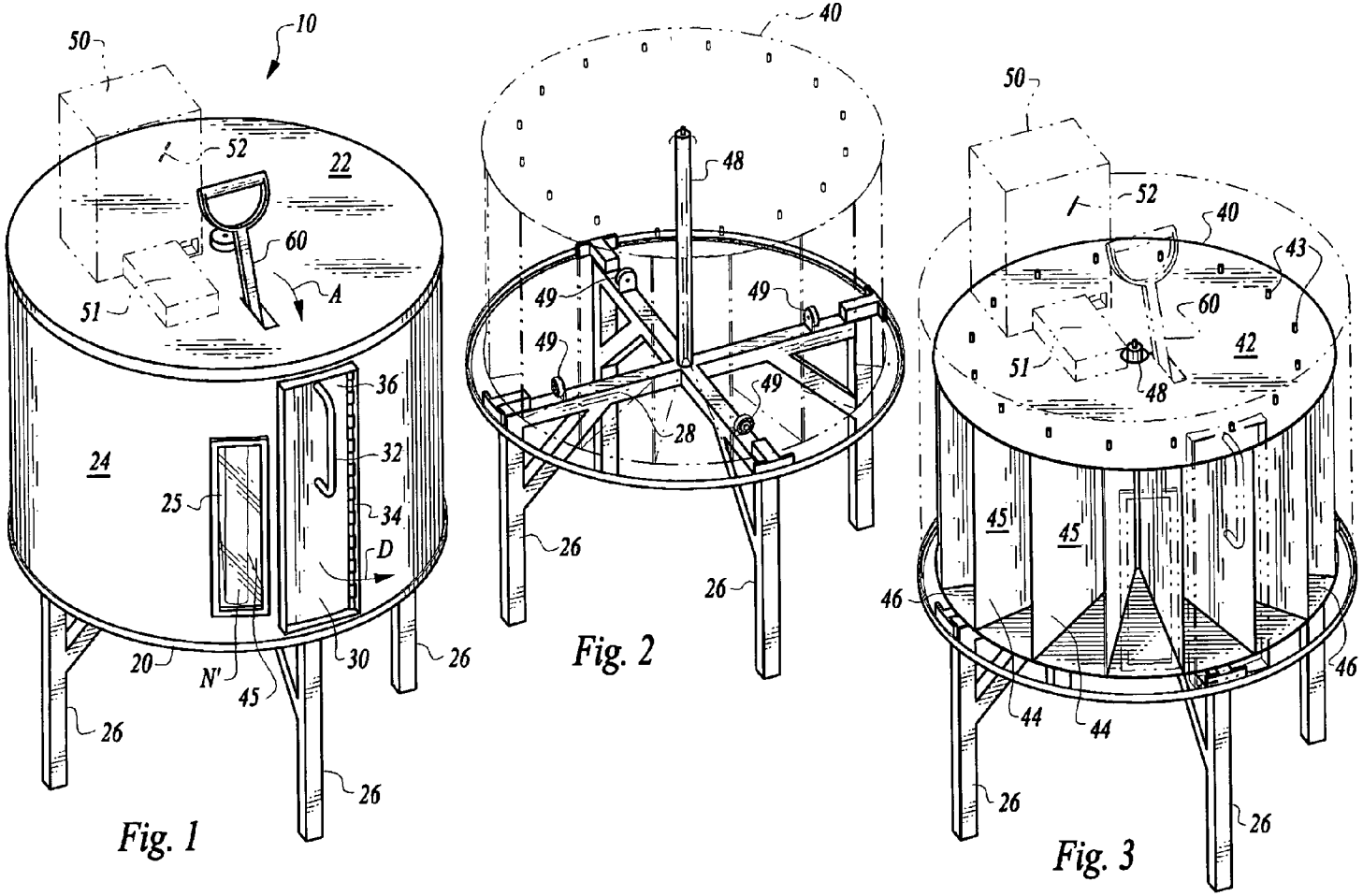
FIG. 1 is a perspective view of the dispenser of this invention before use to dispense a newspaper.
FIG. 2 is a perspective view similar to FIG. 1 but with the housing removed to reveal interior details thereof.
FIG. 3 is a perspective view similar to FIGS. 1 and 2 but with the housing removed and with the carousel shown in detail.

Referring to the drawings, wherein like reference numerals represent like parts throughout the various drawing figures, reference numeral 10 (FIG. 1) is directed to a dispenser for dispensing items, and particularly periodicals such as newspapers N'. The dispenser 10 is of a variety which includes a carousel 40 (FIG. 3) rotatably supported within a housing 20. Individual newspapers N' or other periodicals are accessed by utilizing a coin-op 50 to release a lever 60 for rotating the carousel 40, and for releasing a door 30. The door 30 allows a purchaser to gain access into the housing 20 and one cell within the carousel 40 in which the newspaper N' or other item is located.

In essence, and with particular reference to FIGS. 1-3, basic details of the dispenser 10 of this invention are described according to a preferred embodiment. The housing 20 is a hollow generally cylindrical enclosure. A door 30 is preferably located on a side of the housing 20. A carousel 40 (FIGS. 2 and 3) is rotatably supported within the housing 20. The carousel 40 has multiple separate cells 45 which each contain an item to be dispensed, such as a newspaper N'.

A coin-op 50 can be mounted upon the housing 20 of the dispenser 10. The coin-op 50 controls the locking and unlocking of a rotator for the carousel 40 and releases a latch 72 controlling function of the door 30. When the coin-op 50 receives coins, a lever 60 can be rotated (along arrow A) and cause both a door control assembly 70 and a carousel control assembly 80 to function. The door control assembly 70 releases the latch 72, allowing the door 30 to be opened (about arrow D). The carousel control assembly 80 causes the carousel 40 to be rotated and advance cells 45 of the carousel 40 one place (typically in a counterclockwise direction). A window 25 in the housing 20 reveals to a user whether additional items remain to vended by allowing the user to look into a cell 45 of the carousel 40 which would next be advanced to alignment with the door 30, should coins be placed into the coin-op 50.

A carousel release 90 is also provided which allows the carousel 40 to be rotated freely. This carousel release 90 would typically be utilized by service personnel to load new items into the cells 45 of the carousel 40. The cells 45 are sufficiently isolated from each other to preclude theft of items from cells 45 other than a cell 45 aligned with the door 30.

More specifically, and with particular reference to FIGS. 1-3, details of the housing 20 are described according to a preferred embodiment. The housing 20 is preferably cylindrical in form and hollow, with a size to receive the carousel 40 therein. The housing 20 preferably includes a circular planar lid 22 defining an upper portion of the housing 20. A side wall 24 extends cylindrically down from the lid 22. A window 25 is formed in the side wall 24 adjacent to a space over which the door 30 is mounted. This window 25 is preferably fitted with some form of transparent material (i.e. glass) to allow a user to view a cell 45 of the carousel 40 which would next be aligned with the door 30 should additional coins be placed into the coin-op 50 of the dispenser 10 and the lever 60 manipulated.

The housing 20 is supported upon legs 26 through a skeleton 28 (FIG. 2) which provides robust support for the housing 20 and carousel 40 located therein. All of the parts of the housing are preferably formed to resist vandalism or unauthorized access to items in the housing, and to allow for function of the dispenser 10 in an outdoor environment.

The housing 20 is preferably formed so that it is a structure separate from the carousel 40 and separate from the coin-op 50, as well as other mechanisms including the door control assembly 70 and carousel control assembly 80. The various assemblies 70, 80 are preferably mounted to an underside of the lid 22 of the housing 20 to allow easy access for repair or substitution, by removal of the lid 22. Also, if any of these assemblies 70, 80 require replacement, only the lid 22 of the housing 20 need be replaced.

Also, the coin-op 50 is preferably a prior art coin-op such as that provided on a standard newspaper dispensing machine (such as that provided by Kasper Wire Works Incorporated of Shiner, Tex.). Thus, coin-ops 50 from other newspaper dispensers can potentially be swapped with the dispenser 10 of this invention or the coin-op 50 can be readily replaced when broken.

The side wall 24 of the housing 20 has significant cylindrical space which is substantially featureless. Most preferably this surface provides an advertising surface which could identify the name of the periodical being dispensed, or could include slots for insertion of an entire front page of a newspaper, magazine or other periodical so that a prospective purchaser can readily see what news stories are contained within the newspapers or other periodicals being dispensed.

The door 30 is preferably a pivoting door including a handle 32 on an outer surface of the door 30 and a hinge 34 along one side of the door 30. A top edge 36 of the door 30 interfaces with the door control assembly 70 (FIGS. 6-12) as described in detail above. The door 30 could include a window therein or be configured so that it slides or pivots in a manner different than the pivoting shown in the door 30 of the preferred embodiment. Also, it is conceivable that no door 30 could be provided, but rather just an opening (generally referred to as a discharge port) could be provided which is always open to one of the cells 45. While access restriction to a single cell 45 is preferred, the opening width and cell 45 width could be modified to provide for multiple cell 45 access while still precluding access to some cells 45.

With particular reference to FIGS. 2 and 3, details of the carousel 40 are described according to a preferred embodiment. The carousel 40 is sized to fit within an interior of the housing 20 and to rotate within the housing 20. The carousel 40 includes a cap 42 which is most preferably which is generally circular in form. Index pins 43 extend vertically up from the cap 42 and are engaged by the carousel control assembly 80 (FIGS. 13-18), described in detail below.

Figure 23:
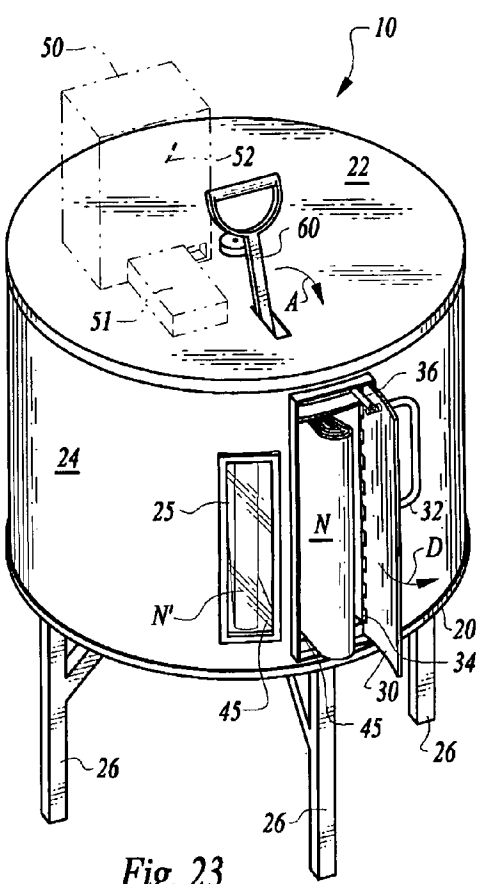
FIG. 23 is a perspective view similar to FIG. 1 but after the dispenser has been activated and with the door shown open and a newspaper being dispensed from one of the cells in the carousel through the door.
Figure 20:
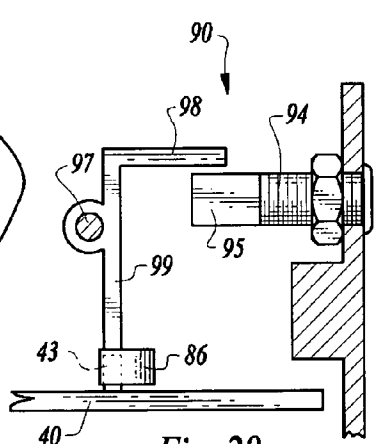
FIG. 20 is an elevation view detail of a portion of that which is shown in FIG. 19.

A plurality of dividers 44 extend down from the cap 42 to a floor 46. The dividers 44 are preferably substantially planar and extend radially from a hub 48 of the carousel 40 out to a perimeter edge of the carousel 40. The dividers 44 thus divide the carousel 40 into a plurality of cells 45 which are isolated from each other. Each of these cells 45 are typically wedge shaped and can conveniently contain an item such as a newspaper therein with the "fold" of the newspaper N (FIG. 23) at the widest outer perimeter of each cell 45. The floor 46 is preferably circular and similar in form to the cap 42 so that each of the cells 45 is bounded by the cap 42, the floor 46, and a pair of dividers 44. A plurality of under-bearings 49 are preferably interposed between the floor 46 and the skeleton 28 of the housing 20 so that the carousel 40 can freely rotate within the housing 20.

While it is important that the dividers 44 extend substantially all the way up from the floor 46 to the lid 22 of the housing 20, it is not strictly required that the carousel 40 include the cap 42 or that the dividers 44 be fully coupled to the cap 42. Rather, it is only necessary that the dividers 44 extend sufficiently close to the cap 42 (or the lid 22 if no cap 42 is provided) so that a purchaser who has gained access to one cell 45 cannot gain access to adjacent cells by reaching over (or around) the dividers 44. It is also conceivable that the dividers 44 be made in a non-continuous fashion, such as in the form of a screen or mesh material or might be made of materials which are somewhat flexible so that the sizes of adjacent cells 45 can be altered somewhat.

It is also conceivable that the dividers 44 could be pivotably attached, such as with the dividers 44 attached near a perimeter of the carousel 40 but detached closer to the hub 48. In this way, the individual cells could take on an orientation different than strictly pointing straight into the hub. The entire carousel 40 is preferably a rigid structure separate from the housing 20 and the other assemblies 70, 80, 90 of this invention, such that carousels 40 can be replaced when damaged, or otherwise removed or replaced when necessary.

Figure 4:
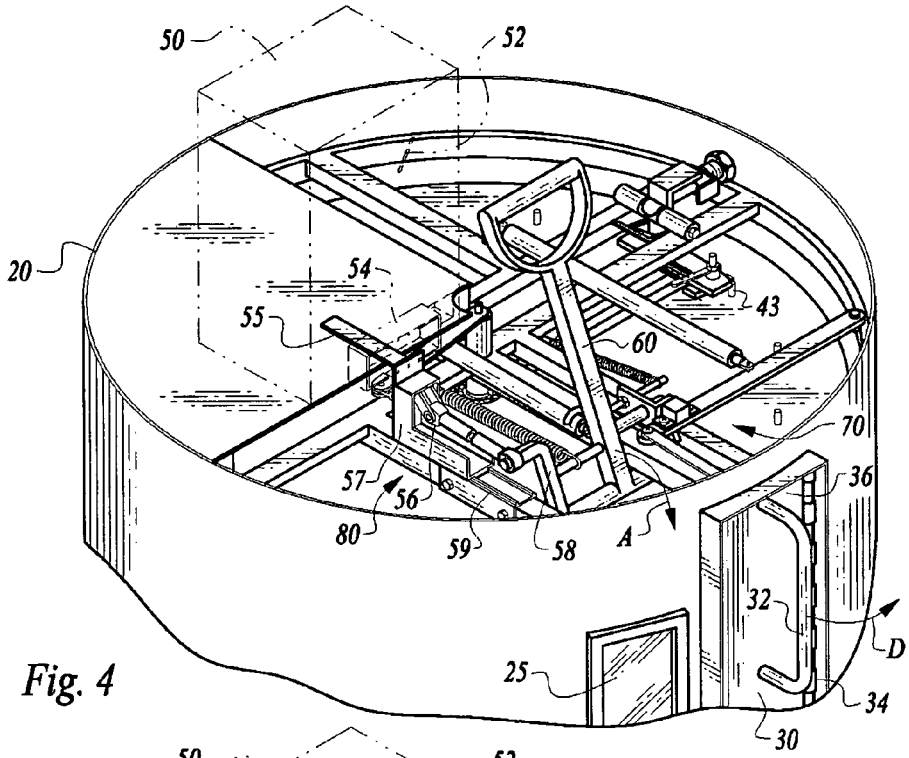
FIG. 4 is a perspective view of an upper portion of the dispenser with a lid of the housing removed to show the various details of the door control assembly, and carousel control assembly.
Figure 5:
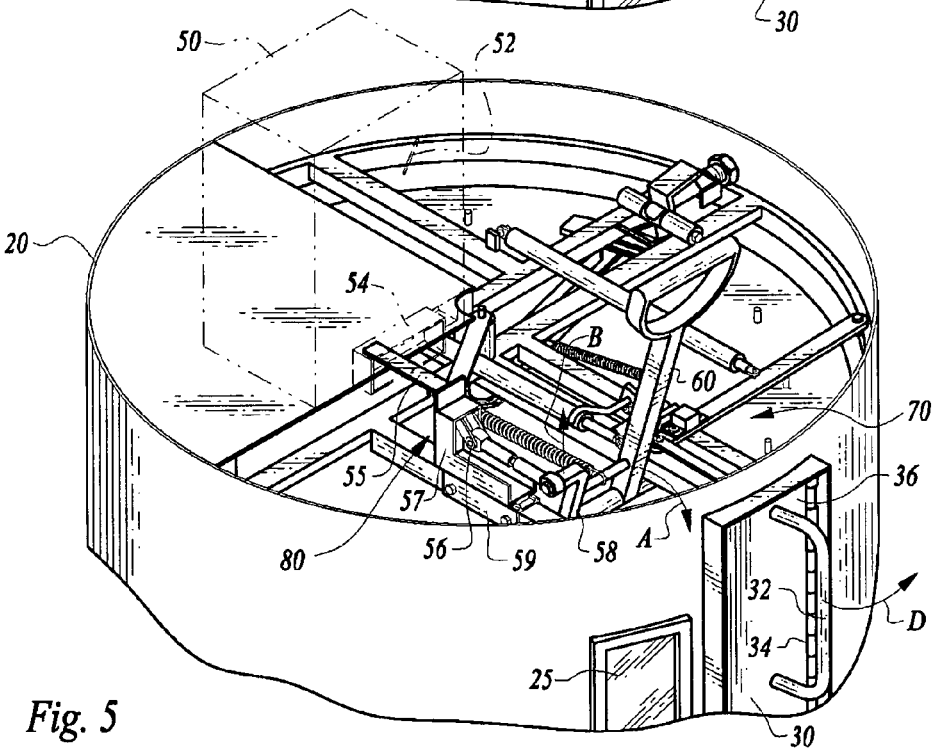
FIG. 5 is a perspective view similar to FIG. 4 but after the lever has been moved.

With particular reference to FIGS. 4 and 5, details of the coin-op 50 are described according to a preferred embodiment. The coin-op 50 is shown in broken lines in that it is a prior art device which has merely been coupled to the dispenser 10 of this invention to facilitate control of the operation of the dispenser 10 to only when appropriate payment has been made through the coin-op 50. An interface between the coin-op 50 and the dispenser 10 is enclosed within a cover 51 (FIGS. 1, 3 and 23) which would be added as part of this invention.

The coin-op 50 includes a slot 52 into which coins are placed when the dispenser 10 is to be activated. A lock/release port 54 (FIGS. 4 and 5) is provided on a front side of the coin-op 50. A tongue 55 is provided which slides into and out of the lock/release port 54. In particular, when appropriate coins have been placed within the slot 52 of the coin-op 50, the tongue 55 is allowed to slide out of the lock/release port 54 somewhat. When the tongue 55 is returned back into the lock/release port 54, the tongue 55 is recaptured until further coins are placed into the slot 52 of the coin-op 50.

The tongue 55 is coupled to a tongue drive linkage 56 which couples the tongue 55 to the lever 60 through an input 58 extending from the lever 60. In particular, the input 58 is fixed to the lever 60 so that the input 58 rotates along with the lever 60 (arrow A). The input 58 is coupled to the tongue drive linkage 56 which is held upon a slide 57 mounted upon a track 59. This slide 57 cannot move unless the tongue 55 has been released through utilization of the coin-op 50. Once the slide 57 is allowed to move, it will in fact move when the lever 60 is rotated (about arrow A). This movement of the slide 57 will not only cause the tongue 55 to slide somewhat out of the lock/release port 54 of the coin-op 50, but also cause a drive 66 of the carousel control assembly 80 to be rotated, in turn causing the carousel 40 to rotate, as described in detail below. Because the coin-op 50, through the tongue 55, allows the lever 60 to be rotated, the lever 60 can furthermore also actuate the door control assembly 70 (FIGS. 6-12) so that the door 30 can be opened to gain access to one of the cells 45 in the carousel 40 for removal of an item according to this invention.

The tongue 55 and tongue drive linkage 56 as well as the slide 57, track 59 and input 58 are a preferred form of mechanism to provide for release of the lever 60 and associated operation of the door control assembly 70 and carousel control assembly 80. However, these particular linkages could be substituted for cable-in-sleeve drive mechanisms, flexible shaft mechanisms, gear and shaft mechanisms, different configurations of four bar linkages and other linkages, or other substitute mechanisms including servo motor controlled electronic systems, and still provide all of the basic functions provided by the preferred mechanism described in detail above. Each of these portions of the dispenser 10 which are provided for coupling to the coin-op 50 are generally located either underneath the cover 51 (FIGS. 1, 3 and 23) or underneath the lid 22 and above the cap 42 of the carousel 40, such that tampering with the mechanism is prevented.

Figure 6:
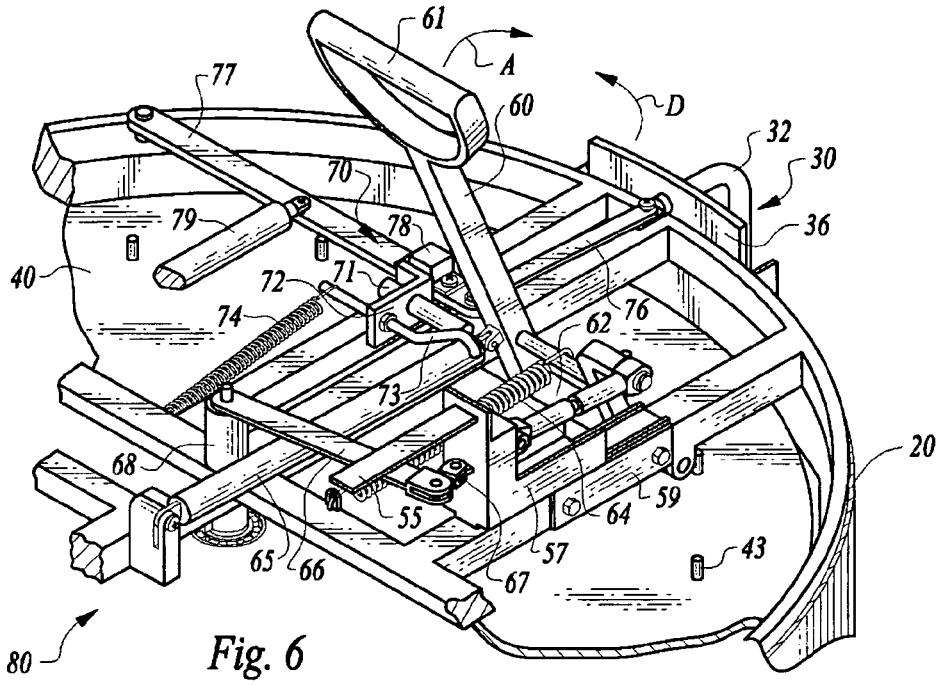
FIG. 6 is a perspective view similar to FIG. 4 but from a reverse angle.
Figure 7:
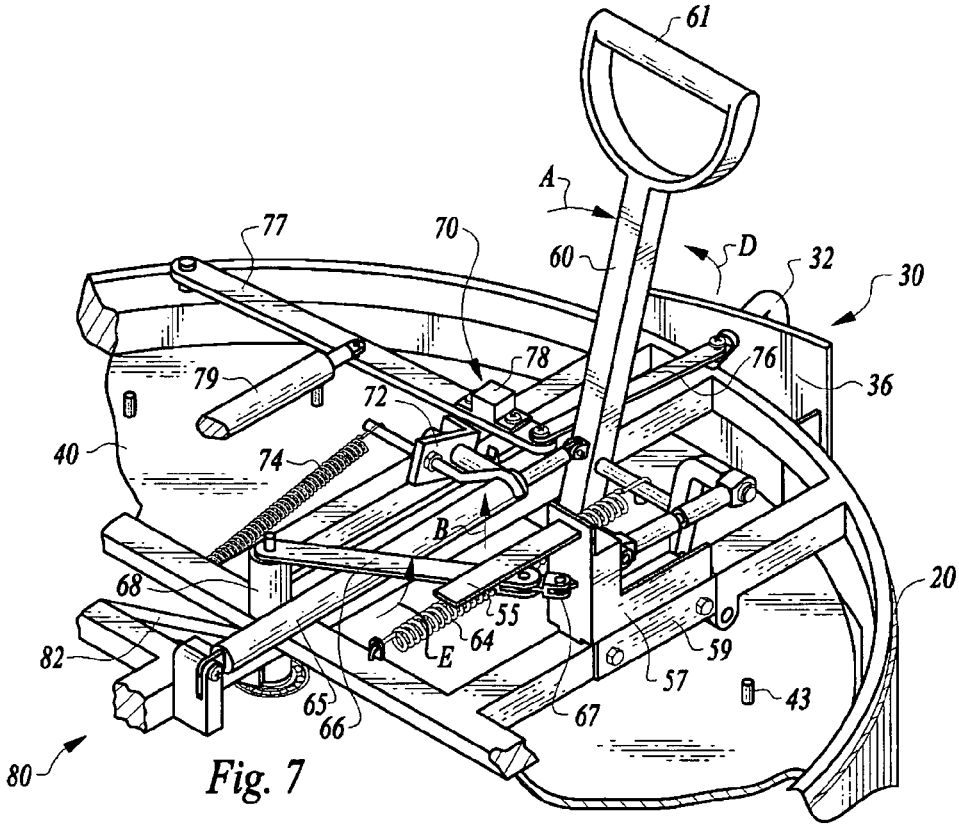
FIG. 7 is a perspective view similar to FIG. 5 but from a reverse angle and as the door begins to be opened.
Figure 8:
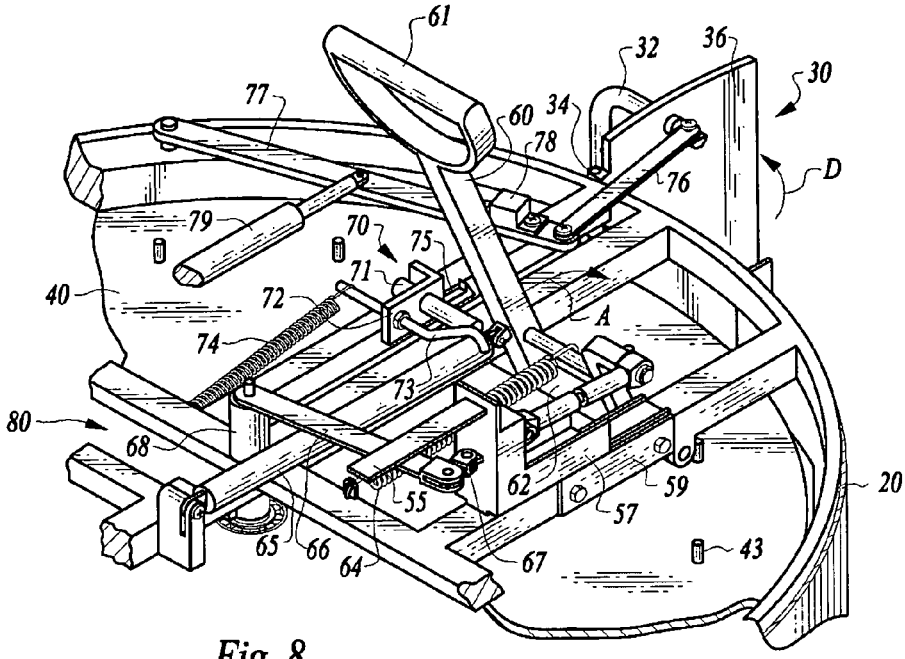
FIG. 8 is a perspective view similar to FIG. 7 but with the door entirely open and with the lever returned to its original position.
Figure 9:
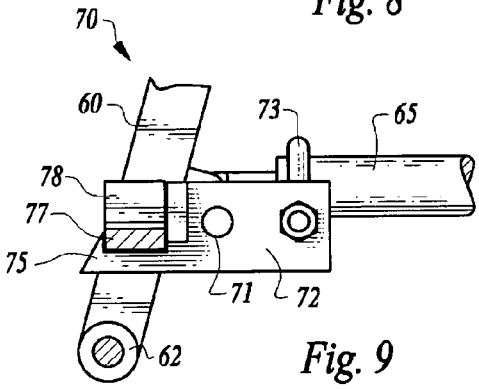
FIGS. 9-12 are detailed side elevation views of a latch associated with the door control assembly of this invention.
Figure 11:
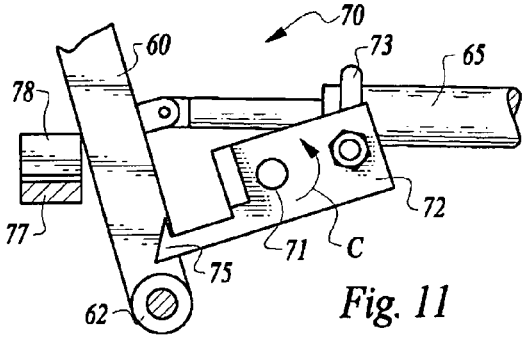
Figure 10:
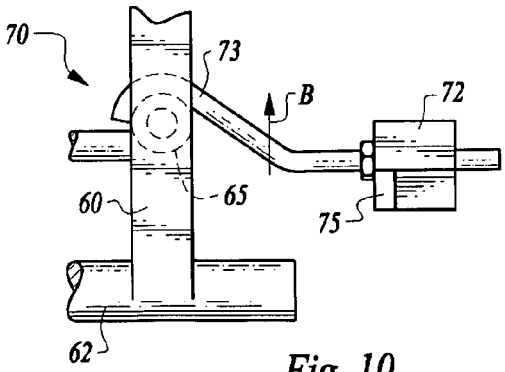
Figure 12:
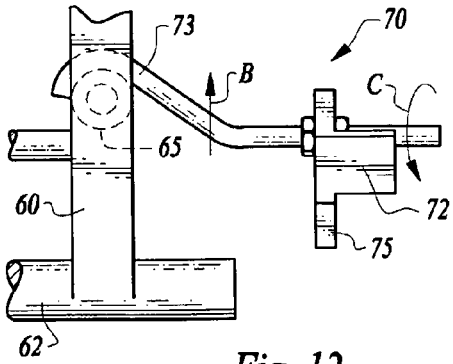
Figure 13:
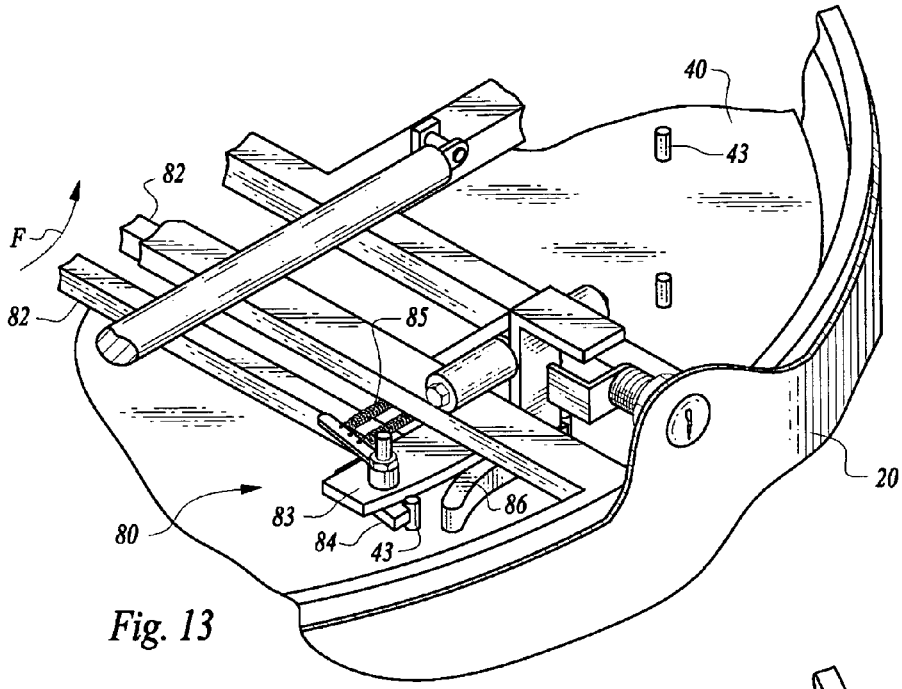
FIGS. 13 and 14 are perspective views of a portion of a carousel control assembly revealing how the carousel is rotated within the housing.
Figure 14:
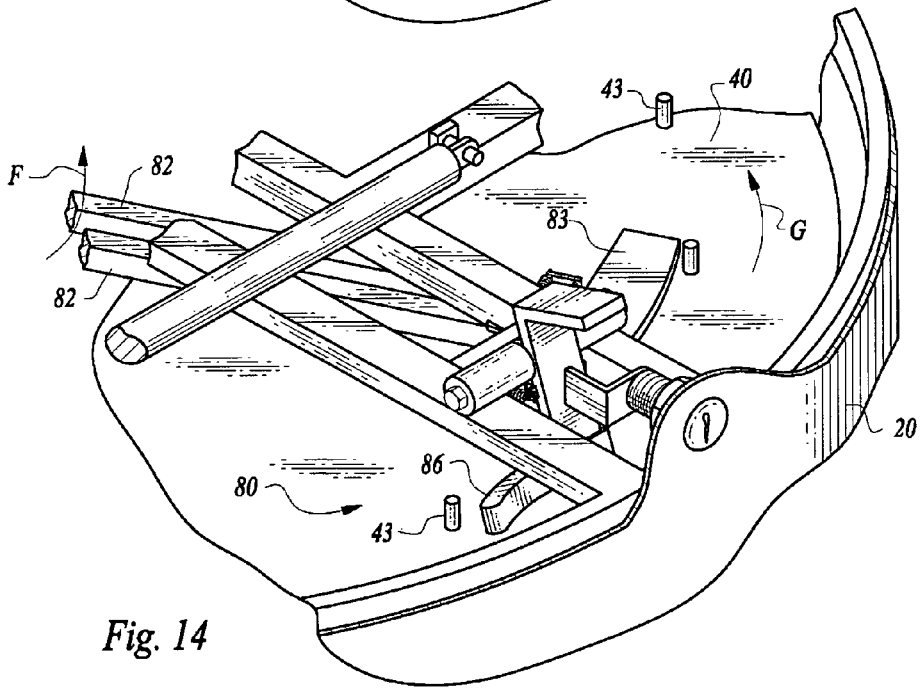

With particular reference to FIGS. 6-8, particular details of the lever 60 and associated structures are described according to a preferred embodiment. The lever 60 provides a location where manual forces can be applied to the dispenser 10 to cause the carousel 40 to be rotated and to cause a latch 72 of the door control assembly 70 to be released, so that the door D can be opened. The lever 60 thus allows the dispenser 10 to operate in an entirely mechanical format without requiring any form of electric or other outside power supply. Alternatively, the lever 60 could be replaced with a servo motor or other electrically controlled actuator with the associated elimination of the input of forces by a user of the dispenser 10.

The lever 60 includes a grip 61 at an upper end thereof for grasping by a user and pulling so that the lever 60 rotates (about arrow A). The lever 60 is a substantially rigid, preferably linear arm which is pivotably supported extending from a pivot 62. A spring 64 is provided which biases the lever 60 towards a first position (FIG. 6). A damper 65 is also provided which causes the lever 60 to only return to its start position (FIG. 6) in a relatively slow fashion. The damper 65 preferably is of a type which includes a spring or other bias integrally therein so that the spring 64 is not strictly required.

Once the coin-op 50 has been utilized so that the lever 60 is unlocked and allowed to be pivoted (along arrow A), the drive 66 coupled to the slide 57 can be rotated (along arrow E of FIG. 7). When the drive 66 is rotated, along with the sub link 67, the axle 68 is also caused to rotate. As best shown in FIGS. 15-18, rotation of the axle 68 causes rotation of the arms 82 of the carousel control assembly 80, so that the carousel 40 is caused to rotate (along arrow G of FIGS. 15-18). Rotation of the lever 60 (about arrow A) thus causes rotation of the drive 66 (about arrow E) along with rotation of the arms 82 (along arrow F) and associated rotation of the carousel 40 (along arrow G). The coin-op 50 thus acts as a preferred form of a payment activated lock disabler, to allow the dispenser 10 to function only when payment is made. Further details of carousel 40 rotation will be described in detail below.

When the lever 60 is rotated (along arrow A), the damper 65 is also caused to be raised somewhat. This raising of the damper 65 acts as an input for release of the latch 72 of the door control assembly 70 described in detail below. In this way, the lever 60 both causes release of the latch 72 and opening of the door 30, as well as rotation of the carousel 40.

With particular reference to FIGS. 6-12, details of the door control assembly 70 are described according to a preferred embodiment. The door control assembly controls a position of the latch 72 for the door 30. When the latch 72 is in a closed position, the door 30 is locked. When the latch 72 is in an open position, the door 30 can be opened. Forces must be applied to the door 30 to cause the door to rotate (about arrow D) so that the door 30 is caused to open. However, these forces will not allow the door 30 to open unless the latch 72 has first been unlocked.

The latch 72 is mounted upon a rotational support 71 so that the entire latch 72 can pivot about this rotational support 71. A finger 73 extends from the latch 72 and over the damper 65 coupled to the lever 60. When the damper 65 is lifted through rotation of the lever 60 (about arrow A), the finger 73 is engaged by the damper 65 and the finger 73 is lifted (along arrow B of FIGS. 10 and 12). This lifting of the finger 73 coupled to the latch 72 causes the latch 72 to rotate (about arrow C of FIGS. 11 and 12). A spring 74 biases the latch 72 toward a locked position, so that the latch 72 remains locked except when the lever 60 is in a forward position.

A claw 75 on the latch 72 holds a bar 77 captured adjacent the latch 72, except when the latch 72 is rotated through movement of the finger 73 (along arrow B) and associated rotation of the latch 72 (along arrow C). When the claw 75 is rotated downward in this way, the bar 77 is released. This bar 77 is coupled to the door 30 and also to a door linkage 76. Together the door linkage 76, bar 77 and door 30 form a four bar linkage (along with a portion of the housing 20).

A magnet 78 is preferably located upon the bar 77 which can engage with a portion of the latch 72. The magnet 78 helps to position the bar 77 in proper position for engagement of the claw 75 about the bar 77 only after the door 30 has been opened. In this way, the latch 72 does not prematurely reengage the bar 77 before a user has an opportunity to open the door 30 and remove an item, such as a newspaper N (FIG. 23), from the cell 45 aligned with the door 30. A damper 79 is preferably located upon the door linkage 76 so that the door 30 does not remain open, but rather is self-closing to return the dispenser 10 back to the original configuration and ready for dispensing another newspaper N or other item.

With particular reference to FIGS. 13-18, details of the carousel control assembly 80 are described according to a preferred embodiment. The carousel control assembly 80 provides a preferred form for advancing the carousel 80 so that a new cell 45 is aligned with the door 30 when the lever 60 is pulled. In particular, when the lever 60 is pulled and the slide 57 is caused to move so that the drive 66 rotates (about arrow E), this in turn causes the axle 68 to rotate so that the arms 82 rotate (about arrow F of FIGS. 15 and 16). The arms 82 extend from the axle 68 out to a head 83. This head 83 has a tooth 84 pivotably attached thereto and spring biased with a spring 85 toward an index pin 83 engaging orientation extending from the head 83 (see FIGS. 13 and 15). In particular, the head 83 has a curving surface which extends up to the index pins 43 but not past the index pins 43 or a sufficient distance to engage the index pins 43. Thus, only the tooth 84 extends sufficiently far to allow engagement with the index pins 43. When the pair of arms 82 are rotated (arrow F of FIG. 15) the tooth 84 on the head 83 engages one of the index pins 43, causing the entire carousel 40 to rotate (arrow G of FIG. 15) along with the rotation of the arms 82 (about arrow F of FIG. 15).

Figure 22:
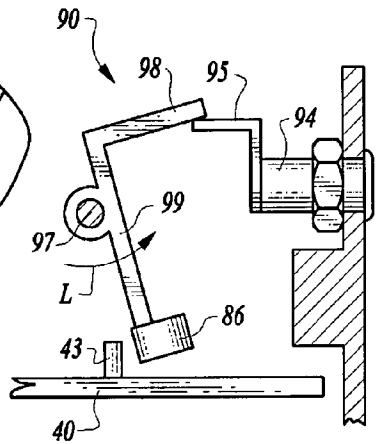
FIG. 22 is an elevation view detail of a portion of that which is shown in FIG. 21.
Figure 21:
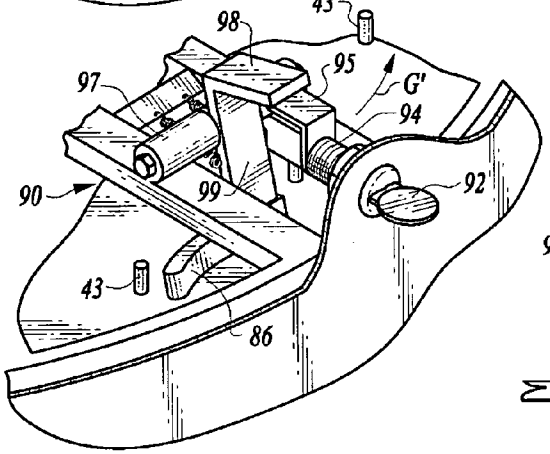
FIG. 21 is a perspective view similar to FIG. 19 but after utilization of the carousel release and showing the carousel in a form able to be freely rotated.

This rotation of the arms 82 along with the carousel 40 continues until the index pin 43 abuts a pawl 86 suspended over the carousel 40 and mounted to the side wall 24 of the housing 20 adjacent the lid 22. The pawl 86 is pivotably mounted so that when the index pin 43 hits the pawl 86, the pawl 86 can rotate slightly and move (along arrow L of FIGS. 16, 19 and 22) out of the way and allow the index pin 43 and the adjacent tooth 84 to move past the pawl 86. This allows the carousel 40 to continue to move (along arrow G of FIG. 16) along with rotation of the arms 82 (along arrow F of FIG. 16).

Figure 15:
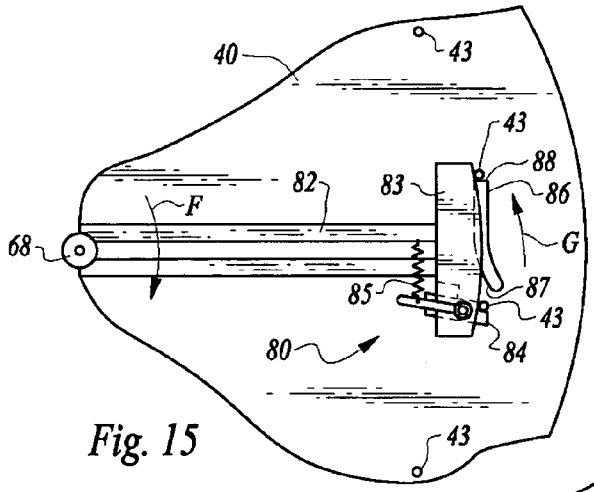
FIGS. 15-18 are top plan views of a portion of the carousel control assembly of this invention showing the various stages in advancing of the carousel when a periodical or other item is being dispensed.
Figure 17:
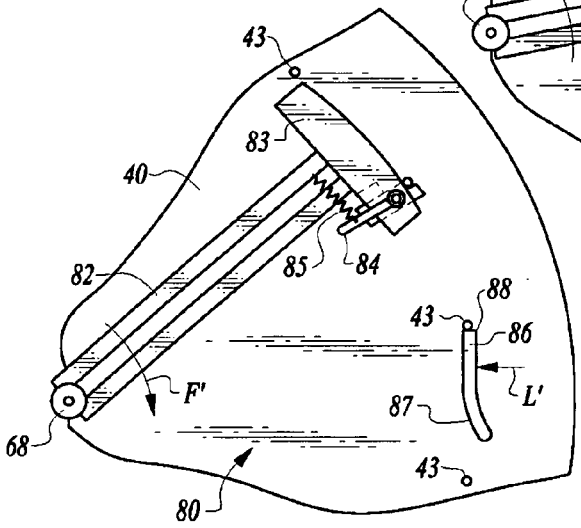

This advancing of the carousel 40 (along arrow G) continues until the entire travel of the arm 82 has been reached (FIG. 17). When the lever 60 is released and the spring 64 causes the lever 60 to return to its original position, the arms 82 are caused to return (along arrow F' of FIG. 17). The tooth 84 then moves away from the index pin 43 it had previously been driving and returns all the way back to its original position (FIG. 15). Along the way however, the tooth 84 strikes another index pin 43 which is adjacent a tip 88 of the pawl 86. The tooth 84 is attached through the spring 85 to the head 83 in a pivoting fashion. Hence, when the tooth 84 strikes the index pin 43, the tooth 43 pivots and the spring 85 is extended. The tooth 84 rotates out of position and the head 83 is allowed to move past the index pin 43, as well as past the pawl 86. The head 83 drags along a face 87 of the pawl 86 without moving the pawl 86 sufficiently to cause the index pin 43 adjacent the tip 88 of the pawl 86 to move away from the pawl 86.

Once the head 83 has been moved entirely back to its starting position (FIG. 15) the tooth 84 has preferably further snapped past another index pin 43 so that the head 83 is ready, along with the tooth 84, to again advance the carousel 40 when another cycle of the carousel control assembly 80 is to occur.

Figure 16:
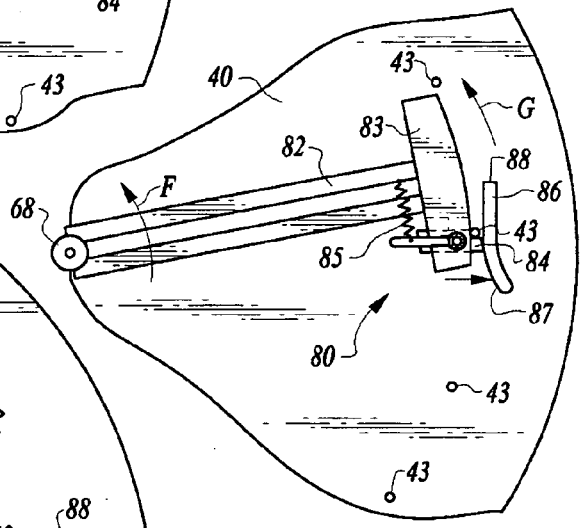

The pawl 86 prevents the carousel 40 from moving backwards (in a direction opposite arrow G of FIGS. 15 and 16). In particular, the tip 88 abuts one of the index pins 43 and resists movement because the tip 88 has engaged the index pin 43, rather than abutting the curving face 87 of the pawl 86 when the index pins 43 are traveling in the counterclockwise direction (about arrow G of FIGS. 15 and 16).

Figure 18:
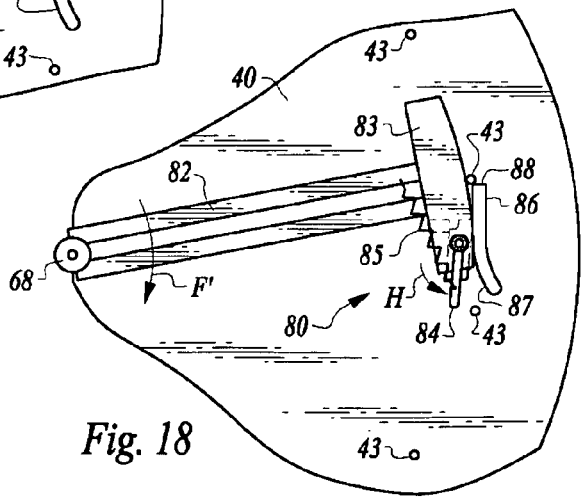

In this configuration, the head 83 is moving past two pins 43 on each return cycle (as the arms 82 move along arrow F' of FIGS. 17 and 18). In such an arrangement, twice as many index pins 43 would be provided as cells 45 within the carousel 40. Alternatively, the travel of the head 83 in the return direction can stop short of the second index pin 43, so that the head 83 and tooth 84 only pass backwards over one index pin 43 before coming to rest and before being reused. In such an alternative arrangement, one index pin 43 would be provided for each cell 45 in the carousel 40.

The entire carousel control assembly 80 described above could be modified with the use of different mechanisms and still provide the desired function according to this invention. For instance, while a pair of arms 82 are shown, a single arm could be used. The arms 82 could also be replaced with a gear set or other linkage mechanisms. Servo motors could also alternatively be utilized.

Most preferably, the pawl 86 can be deactivated through utilization of a carousel release 90 described in detail below, and best shown in FIGS. 19-22. In particular, when a service person desires to load the dispenser 10 with newspapers or other items, the service person would first gain access to the opening, such as by inserting coins into the coin-op 50 or otherwise activate the coin-op 50 so that the lever 60 can be released. The service person would then actuate the lever 60 so that the latch 72 of the door control assembly 70 is moved to an unlocked position and the door 30 can be opened. The door 30 would then be typically propped open during further loading procedures.

Figure 19:
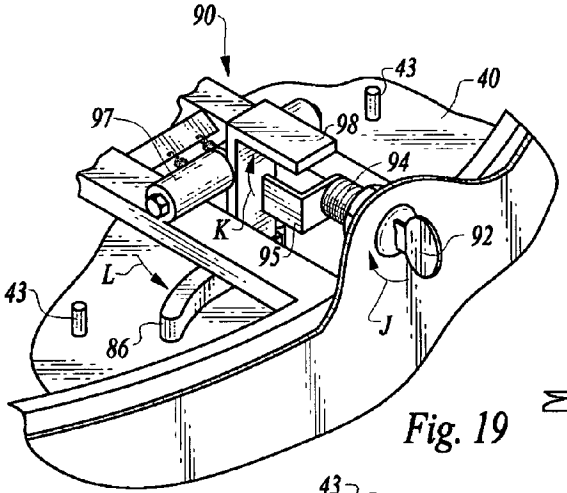
FIG. 19 is a perspective view of the carousel control assembly and an associated carousel release with portions of the housing removed to clearly show the carousel release before its utilization.

The service person would then utilize a key 92 or other service person restricted access tool located adjacent the pawl 86 but on the side wall 24 of the housing 20, and rotate the key 92 (about arrow J of FIG. 19). This in turn causes a lock bolt 94 and associated lifter 95 to be rotated and engage a top tab 98 of an assembly supporting the pawl 86. In particular, the top tab 98 is coupled to a swing arm 99 which is pivotably attached to a fulcrum bearing 97. The swing arm 99 is biased towards a position extending vertically with the pawl 86 in the position described in detail above. However, when the lifter 94 engages the top tab 98, the swing arm 99 is pivoted (about arrow L of FIG. 22) so that the pawl 86 is moved out of position aligned with the index pins 43. The carousel 40 can now be freely rotated in a direction opposite that of arrow G (FIGS. 15 and 16) to selectively place different cells 45 in alignment with the door 30. As the carousel 40 is rotated, each cell 43 is loaded with a newspaper N or other item. When all of the cells 45 have been loaded, the door 30 is released and the key 92 rotated. The dispenser 10 is now ready for use.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A carousel vending machine, comprising in combination:

a housing;

a carousel located within said housing, said carousel adapted to rotate within said housing;

said carousel having a plurality of separate cells, each of said cells located adjacent a portion of a wall of said housing;

said cells substantially isolated from each other;

a door in said housing, said door sized to allow access to only a single cell of said carousel within said housing;

wherein a carousel rotator is provided, said carousel rotator adapted to rotate said carousel to align different cells of said carousel with said door, said rotator adapted to be selectively lockable;

wherein said rotator is adapted to be locked when said door is open, such that only items within a cell aligned with said door can be accessed;

wherein said carousel includes a cap overlying said cells, said cap including a plurality of pins thereon extending up from said cap, said rotator including an advance arm adapted to engage at least one of said pins of said carousel and rotate while adjacent at least one of said pins of said carousel to cause said carousel to rotate along with said arm; and a pawl mounted to said housing, said pawl allowing said pins to pass in a first direction but to preclude passage of said pins in an opposite direction, such that said pawl keeps the carousel moving in only a single direction.

2. The machine of claim 1 wherein said rotator includes a payment actuated lock disabler, such that said rotator is allowed to rotate when payment is made, such rotator rotation causing said arm to rotate one of said pins of said carousel sufficient to advance a new cell into alignment with said door.

3. The machine of claim 2 wherein a window is located in said housing adjacent said door, said window allowing a user to view a cell adjacent said door which will be aligned with said door when said rotator is rotated, such that a user can determine if items remain within the next cell before making payment to unlock said rotator.

* * * * *